US009302483B2

(12) United States Patent
Mizutani

(10) Patent No.: US 9,302,483 B2
(45) Date of Patent: Apr. 5, 2016

(54) INKJET RECORDING APPARATUS

(71) Applicant: Brother Kogyo Kabushiki Kaisha, Nagoya-shi, Aichi-ken (JP)

(72) Inventor: Shunsuke Mizutani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/480,692

(22) Filed: Sep. 9, 2014

(65) Prior Publication Data

US 2015/0091976 A1 Apr. 2, 2015

(30) Foreign Application Priority Data

Sep. 27, 2013 (JP) ..... 2013-201272

(51) Int. Cl.
*B41J 2/165* (2006.01)
*B41J 2/17* (2006.01)

(52) U.S. Cl.
CPC ..... *B41J 2/16526* (2013.01); *B41J 2/16508* (2013.01); *B41J 2/16523* (2013.01); *B41J 2/1707* (2013.01); *B41J 2002/16573* (2013.01)

(58) Field of Classification Search
None
See application file for complete search history.

(56) References Cited

U.S. PATENT DOCUMENTS

| | | | | |
|---|---|---|---|---|
| 2002/0036671 | A1* | 3/2002 | Takahashi et al. | 347/29 |
| 2008/0218549 | A1* | 9/2008 | Iriguchi | 347/14 |
| 2009/0141095 | A1* | 6/2009 | Umeda | 347/85 |
| 2010/0207991 | A1* | 8/2010 | Koizumi | 347/32 |
| 2011/0175966 | A1 | 7/2011 | Kuroda | |

FOREIGN PATENT DOCUMENTS

JP H11-157101 A 6/1999

OTHER PUBLICATIONS

Machine translation of JP 11-157101 A. (JP 11-157101 A was published on Jun. 15, 1999.).*
Human translation of JP 11-157101 A. (JP 11-157101 A was published on Jun. 15, 1999.).*

* cited by examiner

*Primary Examiner* — Justin Seo
(74) *Attorney, Agent, or Firm* — Banner & Witcoff, Ltd.

(57) ABSTRACT

A controller of an inkjet recording apparatus executes, after receiving a recording instruction, first flushing by controlling a recording head to idly eject ink toward a cap from which the ink is discharged by a pump to a detachable waste ink tank. After executing the first flushing, the controller executes image recording by controlling a conveying unit and a recording head to repeat a unit action in which the recording head ejects ink onto a recording medium conveyed by a predetermined line feed length in a conveying direction. After detecting arrival of a flushing timing during the image recording both when a threshold time elapses and when one of repeated unit actions is completed, the controller executes second flushing by controlling the recording head to idly eject ink toward a fixed ink receiving member.

10 Claims, 10 Drawing Sheets

INKJET RECORDING APPARATUS

CROSS-REFERENCE TO RELATED APPLICATION

This application claims priority from Japanese Patent Application No. 2013-201272, filed on Sep. 27, 2013, which is incorporated herein by reference in its entirety.

TECHNICAL FIELD

Aspects disclosed herein relate to an inkjet recording apparatus comprising a maintenance mechanism which includes a replaceable waste ink storage.

BACKGROUND

A known inkjet recording apparatuses comprises a maintenance mechanism disposed at one end of a carriage moving area, and a flushing tray disposed at the other end of the carriage moving area. The maintenance mechanism comprises a cap for covering a nozzle surface of the recording head, a waste ink tank, and a pump for discharging ink sucked from the recording head via the cap to the waste ink tank.

SUMMARY

Aspects of the disclosure provide for an inkjet recording apparatus that is configured to perform flushing to cause a recording head to idly eject ink in a manner that may prevent a reduction of service life of the inkjet recording apparatus.

According to one or more aspects of the disclosure, an inkjet recording apparatus may comprise a conveying unit configured to convey a recording medium in a conveying direction; a carriage configured to move in a main scanning direction perpendicular to the conveying direction; a recording head mounted on the carriage and configured to face the recording medium conveyed in a recording area by the conveying unit and to eject ink; a maintenance mechanism; an ink receiving member; and a controller. The maintenance mechanism comprises a cap disposed in a first outside area which is outside of the recording area in the main scanning direction, a waste ink storage detachably attached to the inkjet recording apparatus, and a pump configured to discharge ink in the cap to the waste ink storage. The ink receiving member is fixedly attached, in a second outside area, to the inkjet recording apparatus. The second outside area is outside of the recording area in the main scanning direction and opposite to the first outside area relative to the recording area. The controller is configured to receive a recording instruction for recording an image on the recording medium; execute, after receiving the recording instruction, first flushing by controlling the recording head to idly eject ink toward the cap; execute, after executing the first flushing, image recording by controlling the conveying unit and the recording head to repeat a unit action in which the recording head ejects ink onto the recording medium conveyed by a predetermined line feed length in the conveying direction; detect arrival of one or more flushing timings; and execute, after detecting the arrival of a flushing timing, second flushing by controlling the recording head to idly eject ink toward the ink receiving member. Each flushing timing arrives during the image recording both when a threshold time elapses and when one of repeated unit actions is completed.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
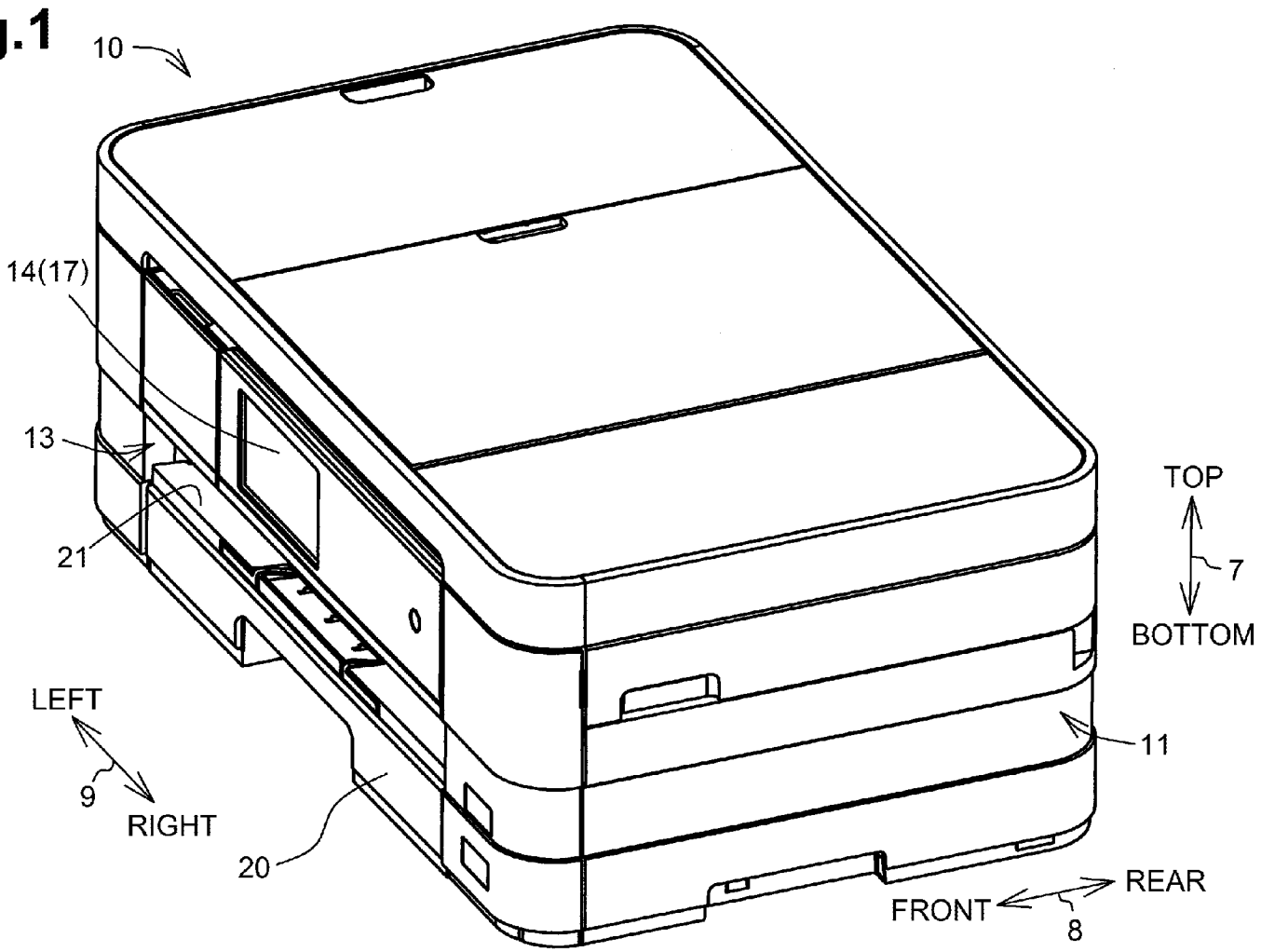
FIG. 1 is a perspective view depicting an appearance of a multifunction device in an illustrative embodiment according to one or more aspects of the disclosure.

An illustrative embodiment according to one or more aspects will be described below with reference to the accompanying drawings. The illustrative embodiment described below is merely an example. Various changes, arrangements and modifications may be applied therein without departing from the spirit and scope of the disclosure. In the description below, a top-bottom direction 7 is defined with reference to an orientation of a multifunction device 10 that is disposed in an orientation in which it is intended to be used (e.g., an orientation depicted in FIG. 1). A side of the multifunction device 10, in which an opening 13 is defined, is defined as the front of the multifunction device 10. A front-rear direction 8 is defined with reference to the front of the multifunction device 10. A right-left direction 9 is defined with respect to the multifunction device 10 as viewed from its front.

[Overall Configuration of Multifunction Device 10]

Figure 2:
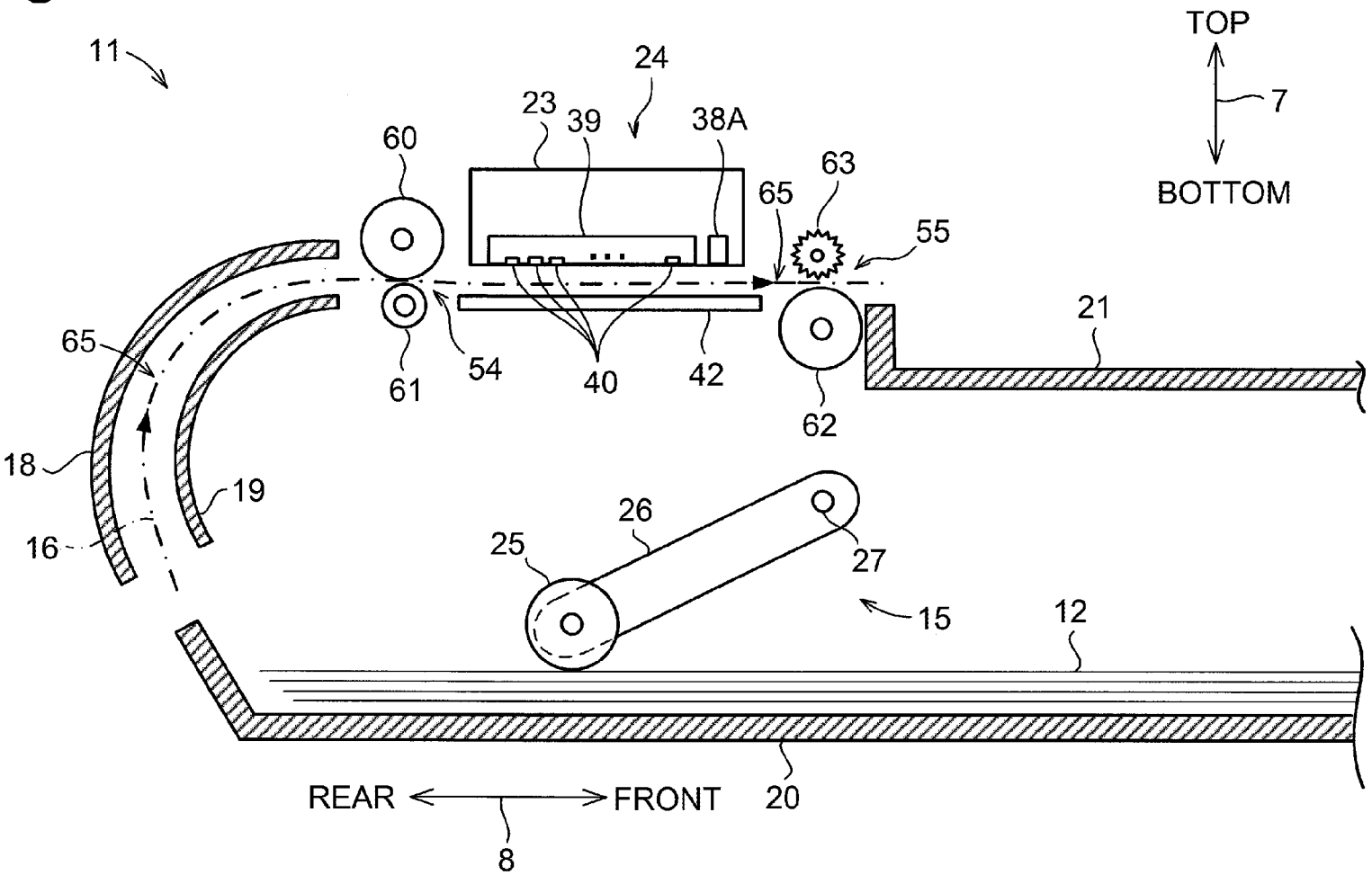
FIG. 2 is a vertical schematic sectional view depicting an internal structure of a printer unit of the multifunction device in the illustrative embodiment according to one or more aspects of the disclosure.

As depicted in FIG. 1, the multifunction device 10 has a substantially rectangular parallelepiped shape. The multifunction device 10 includes a printer unit 11 disposed at its lower portion, a display 14, and an operation unit 17. The printer unit 11 is configured to record one or more images onto one or more sheets 12 (see FIG. 2) using an inkjet recording method. As depicted in FIG. 2, the printer unit 11 includes a feed unit 15, a feed tray 20, a discharge tray 21, a conveyor roller pair 54, a recording unit 24, a discharge roller pair 55, and a platen 42. Components of the printer unit 11 are supported by a frame 68 depicted in FIG. 3B. The multifunction device 10 has various functions, e.g., a facsimile function and a printing function. The multifunction device 10 is an example of an inkjet recording apparatus. The conveyor roller pair 54 and the discharge roller pair 55 are an example of a conveying unit.

[Feed Tray 20 and Discharge Tray 21]

As depicted in FIG. 1, the feed tray 20 is insertable into and removable from the printer unit 11 in the front-rear direction 8 via the opening 13 defined in the front of the printer unit 11. The feed tray 20 is configured to hold sheets 12 to be fed by the feed unit 15 to a conveying path 65. The discharge tray 21 is disposed above the feed tray 20 and configured to receive the sheets 12 discharged, via the opening 13, by the discharge roller pair 55.

[Feed Unit 15]

As depicted in FIG. 2, the feed unit 15 includes a feed roller 25, a feed arm 26, and a shaft 27. The feed roller 25 is rotatably supported at a distal end portion of the feed arm 26. When the conveyor motor 101 (See FIG. 8) is driven to rotate reversely, the feed roller 25 rotates forward, i.e., in a direction to feed the sheet 12 in the conveying direction 16. The feed arm 26 is pivotably supported by the shaft 27. The shaft 27 is supported by the frame 68 of the printer unit 11. The feed arm 26 is urged to pivot toward the feed tray 20 by its own weight and/or by an elastic force of, for example, a spring.

[Conveying Path 65]

As depicted in FIG. 2, a portion of the conveying path 65 is defined by an outer guide member 18 and an inner guide member 19 spaced apart from each other at a predetermined distance in the printer unit 11. The conveying path 65 extends from a rear end of the feed tray 20 toward the rear of the printer unit 11. The conveying path 65 extends upwardly in a U-shaped manner toward the front to the discharge tray 21 via the recording unit 24. The conveying direction 16 of the sheet 12 along the conveying path 65 is indicated by a dotted-and-dashed line in FIG. 2.

[Conveyor Roller Pair 54]

As depicted in FIG. 2, the conveyor roller pair 54 is upstream of the recording unit 24 in the conveying direction 16. The conveyor roller pair 54 includes a conveyor roller 60 and a pinch roller 61 which are opposite to each other. When the conveyor motor 102 is driven forward, the conveyor roller 60 rotate forward. The pinch roller 61 rotates following the rotation of the conveyor roller 60. The conveyor roller 60 and the pinch roller 61 pinch the sheet 12 therebetween and convey the sheet 12 in the conveying direction 16.

[Discharge Roller Pair 55]

The discharge roller pair 55 is disposed downstream of the recording unit 24 in the conveying direction 16. The discharge roller pair 55 includes a discharge roller 62 and a spur 63 which are opposite to each other. When the conveyor motor 102 is driven to rotate forward, the discharge roller 62 rotates forward. The spur 63 rotates following the rotation of the discharge roller 62. The discharge roller 62 and the spur 63 pinch the sheet 12 therebetween and convey the sheet 12 in the conveying direction 16.

[Platen 42]

Figure 3A:
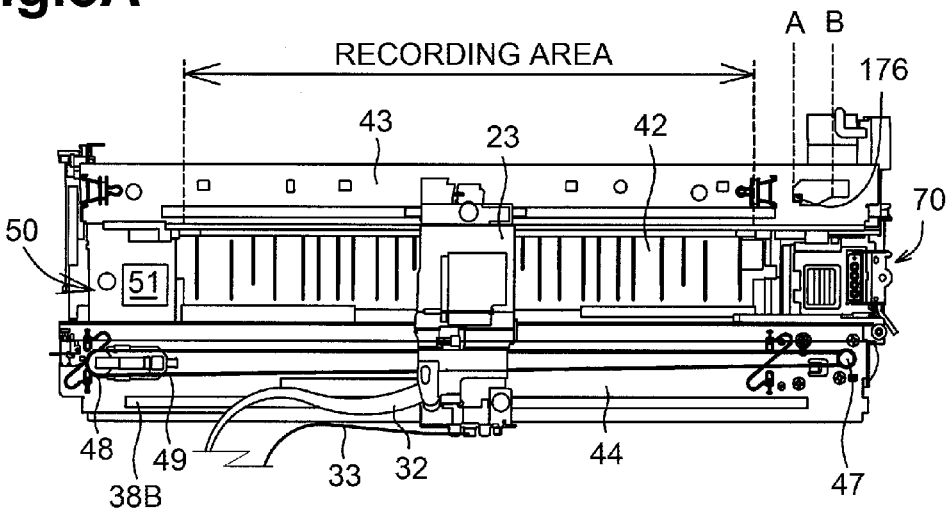
FIG. 3A is a plan view depicting a carriage and guide rails in the illustrative embodiment according to one or more aspects of the disclosure.

As depicted in FIGS. 2 and 3A, the platen 42 is disposed between the conveyor roller pair 54 and the discharge roller pair 55 in the conveying direction 16. The platen 42 is disposed opposite to the recording unit 24 in the top-bottom direction 7. The platen 42 is configured to support from below the sheet 12 being conveyed by the conveyor roller pair 54.

[Recording Unit 24]

As depicted in FIG. 2, the recording unit 24 is disposed between the conveyor roller pair 54 and the discharge roller pair 55 in the conveying direction 16. The recording unit 24 includes a carriage 23, a recording head 39, and an encoder sensor 38A. As depicted in FIG. 3A, ink tubes 32 and a flexible flat cable 33 extend from the carriage 23. The ink tubes 32 are configured to supply ink stored in respective ink cartridges to the recording head 39. The flexible flat cable 33 connects a circuit board including a controller 130 to the recording head 39.

Figure 3B:
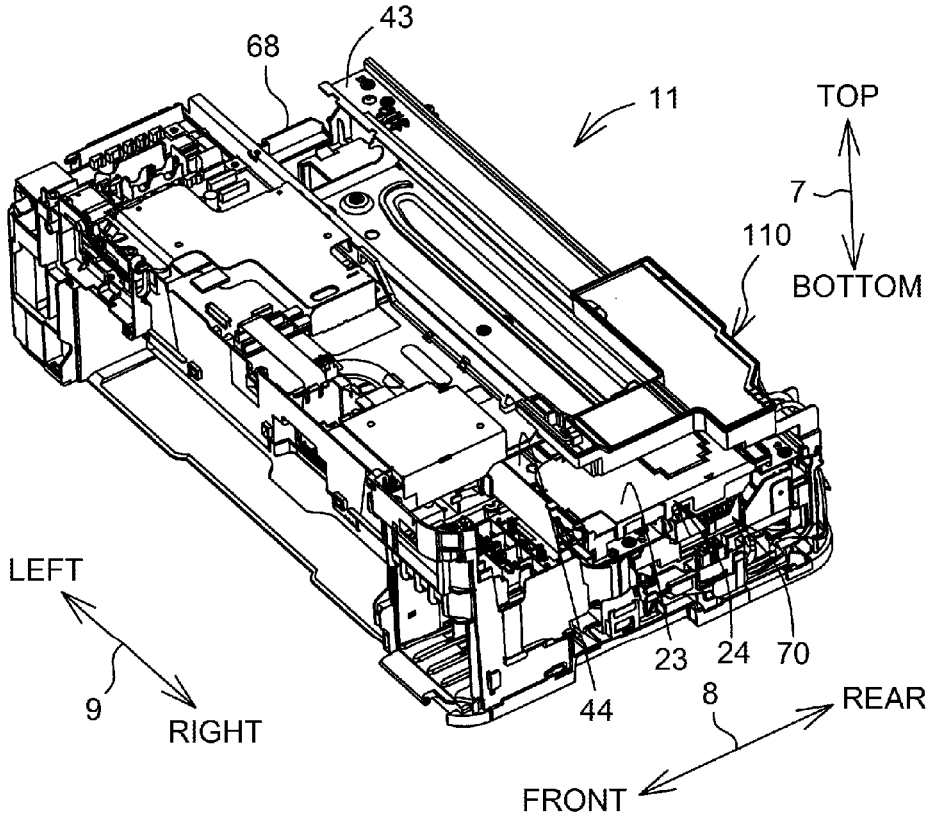
FIG. 3B is a perspective view depicting the printer unit in the illustrative embodiment according to one or more aspects of the disclosure.

As depicted in FIG. 3A, the carriage 23 is supported by guide rails 43 and 44. The guide rails 43 and 44 are spaced apart from each other in the front-rear direction 8 and extend respectively in the right-left direction 9. As depicted in FIG. 3B, the guide rails 43 and 44 are supported by the frame 68 of the printer unit 11. The carriage 23 is connected with a known belt mechanism disposed at the guide rail 44. The belt mechanism includes a drive pulley 47, a following pulley 48, and an endless belt 49. The drive pulley 47 is disposed at a right end portion of the guide rail 44 in the right-left direction 9. The following pulley 48 is disposed at a left end portion of the guide rail 44 in the right-left direction 9. The belt 49 is wound between the drive pulley 47 and the following pulley 48. The belt 49 is connected with a bottom of the carriage 23. The drive pulley 47 is driven, by the carriage motor 103, to rotate and circulate the belt 49, whereby the carriage 23 reciprocates in a main scanning direction which is along the right-left direction 9.

As depicted in FIG. 2, the recording head 39 is mounted on the carriage 23. The recording head 39 has a plurality of nozzles 40 in its bottom surface. The recording head 39 is configured to eject minuscule droplets of ink from appropriate ones of the nozzles 40. While the carriage 23 reciprocates, the recording head 39 ejects ink droplets toward the sheet 12 supported by the platen 42, thereby recording an image on the sheet 12.

An encoder strip 38B is disposed on the guide rail 44. The encoder strip 38B extends in the right-left direction 9. The encoder sensor 38A is disposed on a bottom surface of the carriage 23. The encoder sensor 38A and the encoder strip 38B are disposed opposite to each other in the top-bottom direction 7. While the carriage 23 reciprocates, the encoder sensor 38A reads the encoder strip 38B to generate pulse signals and outputs the generated pulse signals to the controller 130. The encoder sensor 38A and the encoder strip 38B constitute a carriage sensor 38 depicted in FIG. 8.

[Maintenance Mechanism 70]

Figure 4A:
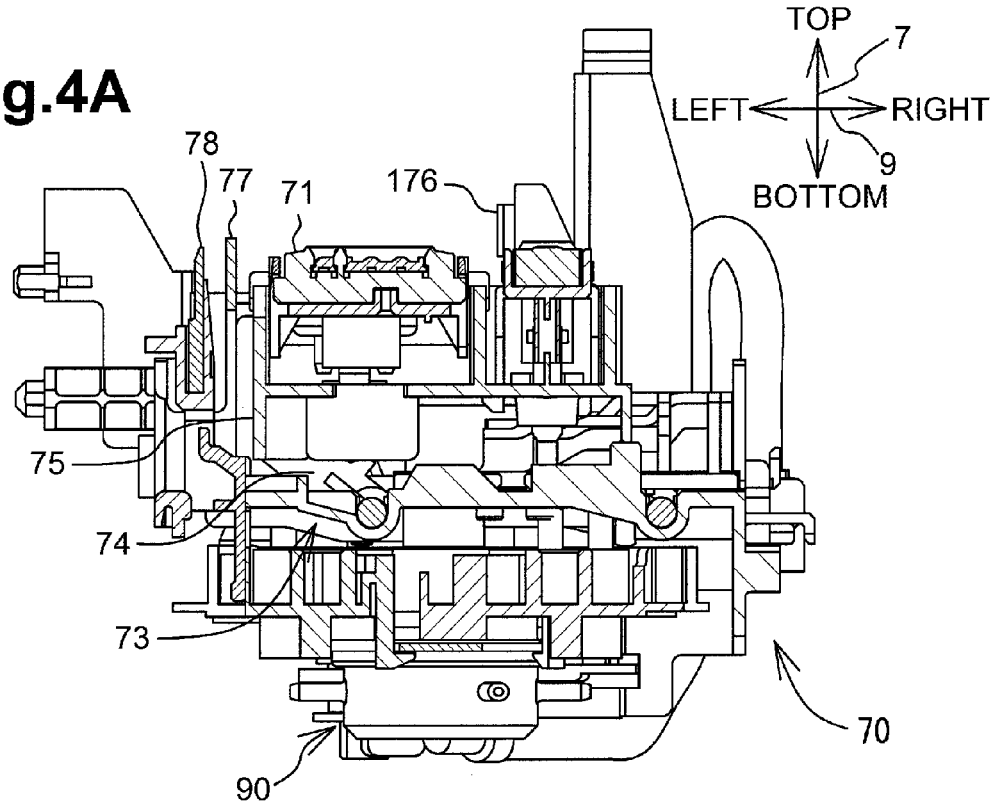
FIG. 4A is a sectional view depicting a maintenance mechanism, wherein the carriage is located at a position A in the illustrative embodiment according to one or more aspects of the disclosure.
Figure 4B:
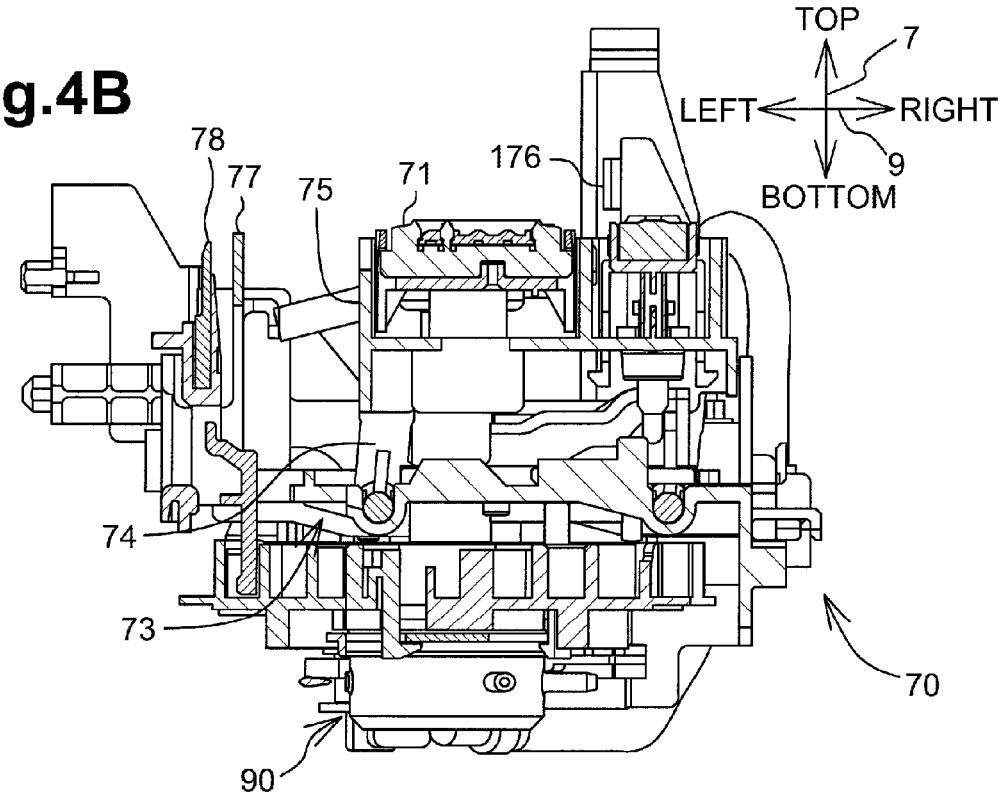
FIG. 4B is a sectional view depicting the maintenance mechanism, wherein the carriage is located at a position B in the illustrative embodiment according to one or more aspects of the disclosure.
Figure 5:
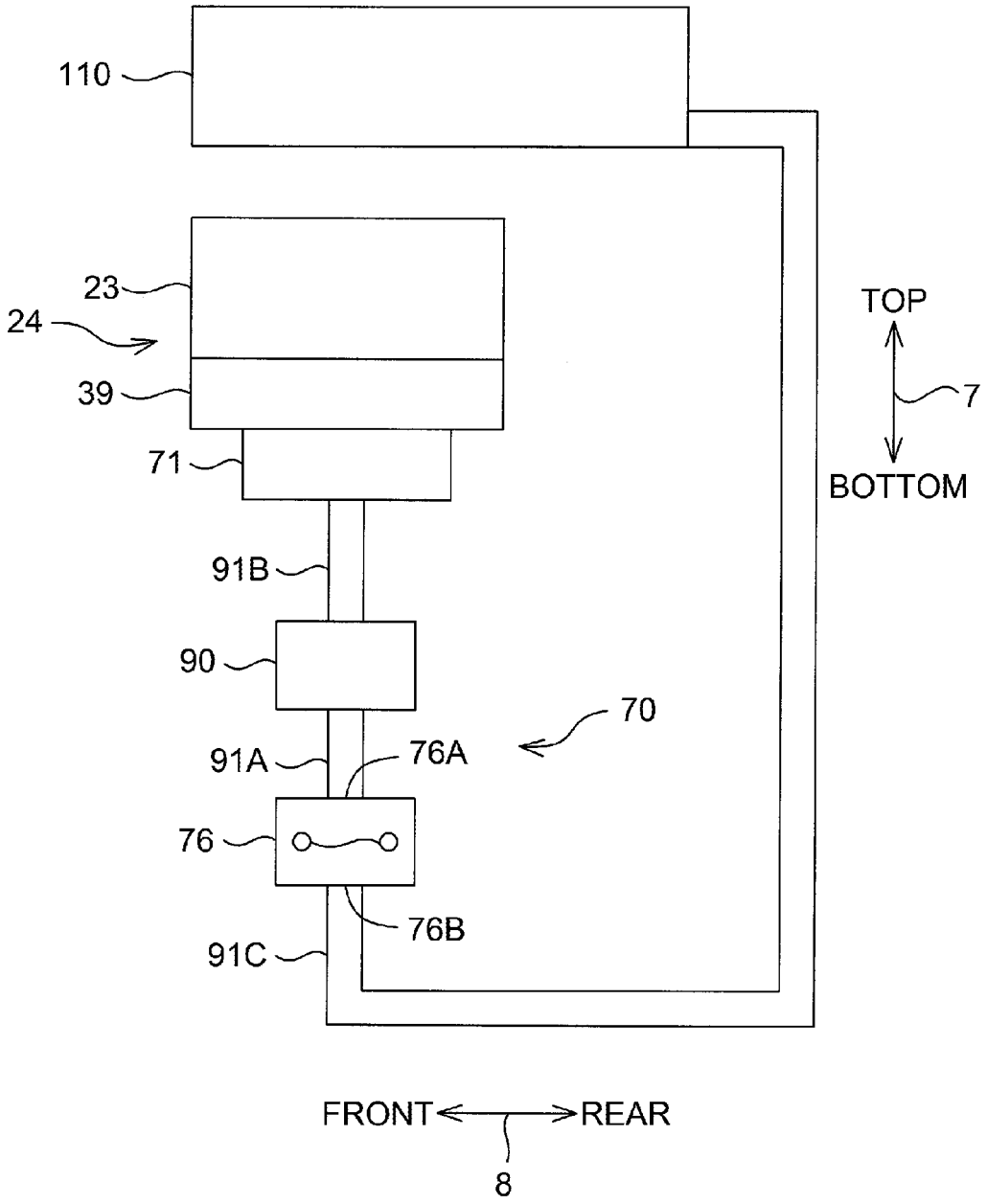
FIG. 5 is a schematic diagram depicting the maintenance mechanism in the illustrative embodiment according to one or more aspects of the disclosure.

The multifunction device 10 further includes a maintenance mechanism 70 depicted in FIGS. 4 and 5. As depicted in FIG. 3A, the maintenance mechanism 70 is disposed to the right of the area in which the carriage 23 reciprocates during image recording (hereinafter, referred to as a recording area"). The recording area is an area in which the recording head 39 faces the sheet 12 on the platen 42. When the carriage 23 is located to the right of the recording area, the maintenance mechanism 70 perform purging by sucking ink from the nozzles 40 to eliminate air bubbles or foreign objects together with ink. The maintenance mechanism 70 includes a cap 71, a lifting mechanism 73, a pump 76 (see FIGS. 5 and 8), and a port switching mechanism 90. A waste ink tank 110 (see FIGS. 3B and 5) is configured to store ink sucked and removed by the maintenance mechanism 70. The waste ink tank 110 is an example of a waste ink storage. The area to the right of the recording area is an example of a first outside area which is outside of the recording area in the main scanning direction.

The cap 71 is made of, for example, rubber. The cap 71 is disposed such that the cap 71 faces the carriage 23 when the carriage 23 is located to the right of the recording area. The cap 71 is configured to move between a capping position in which the cap 71 covers a nozzle surface and an uncapping position in which the cap 71 is separated from the nozzle surface. The nozzle surface is a surface of the recording head 39 in which the nozzles 40 are formed. Inside of the cap 71 is divided into two spaces, that is, the cap 71 includes a black-ink cap portion and a color-ink cap portion. The black-ink cap portion is configured to cover a portion of the nozzle surface in which nozzles 40 for ejecting black ink are formed while creating an enclosed space between the portion of the nozzle surface and the black-ink cap portion. The color-ink cap portion is configured to cover another portion of the nozzle surface in which nozzles 40 for ejecting color (cyan, magenta, and yellow) ink are formed while creating an enclosed space between the portion of the nozzle surface and the color-ink cap portion. The black-ink cap portion is connected to a black ink port 95 and the color-ink cap portion is connected to a color ink port 96.

The pump 76 is, for example, a rotary tube pump. When the conveyor motor 102 is driven to rotate forward, the pump 76 is driven to generate a flow of fluid (e.g., ink or air) from an inlet 76A toward an outlet 76B (see FIG. 5). The port switching mechanism 90 is connected to an end of a tube 91A extending from the inlet 76A. The cap 71 is connected to an end of a tube 91B extending from the port switching mechanism 90. That is, the cap 71 and the inlet 76A are in communication with each other via the tubes 91A and 91B and the port switching mechanism 90. The waste ink tank 110 is detachably attached to an end of a tube 91C extending from the outlet 76B.

As depicted in FIG. 4, the lifting mechanism 73 includes a link 74. By rotation of the link 74 in response to the movement of the carriage 23, a holder 75 moves between a position of FIG. 4A and a position of FIG. 4B. The holder 75 supports a contact lever 176 that protrudes upward in the vertical direction. The contact lever 176 extends to the reciprocation area of the carriage 23. The lifting mechanism 73 is configured to move the cap 71 in response to the pressing of the contact lever 176 by the carriage 23. When the carriage 23 is not in contact with the contact lever 176, the cap 71 is separated from the nozzle surface. When the carriage 23 moves rightward from a position A shown in FIG. 3A and contacts the contact lever 176, the lifting mechanism 73 moves the cap 71 toward a position proximate to the nozzle surface.

A wiper blade 78 is disposed in a wiper holder 77 so as to extend from and retract to the wiper holder 78. The wiper blade 78 is configured to move between a contact position in which the wiper blade 78 extends from the wiper holder 77 and contacts the nozzle surface and a separated position in which the wiper blade 78 retracts to the wiper holder 77 and is separated from the nozzle surface. The wiper blade 78 in the contact position wipes ink adhered to the nozzle surface when the carriage 23 slides. When the conveyor motor 102 is driven to rotate reversely, the wiper blade 78 extends from and retracts to the wiper holder 77.

[Port Switching Mechanism 90]

The port switching mechanism 90 is configured to change the communication state between the cap 71 and the pump 76, and to move the cap 71 toward and away from the nozzle surface. As depicted in FIG. 6, the port switching mechanism 90 includes a cylinder 99 having a bottom end and a cylindrical rotary body 92 that is disposed inside the cylinder 99. The cylinder 99 includes a suction port 93, a black ink port 95, a color ink port 96, and atmosphere ports 97 and 98.

The suction port 93 is formed in a bottom wall of the cylinder 99. The other four ports 95-98 are formed circumferentially at predetermined intervals in a side wall of the cylinder 99. The black ink port 95 is in communication with the internal space of the black-ink cap portion via the tube 91B. The color ink port 96 is in communication with the color-ink cap portion via the tube 91B. The atmosphere ports 97 and 98 are open to the atmosphere. One end of the tube 91A is connected to the suction port 93 and the other end of the tube 91A is connected to the inlet 76A of the pump 76.

Figure 6A:
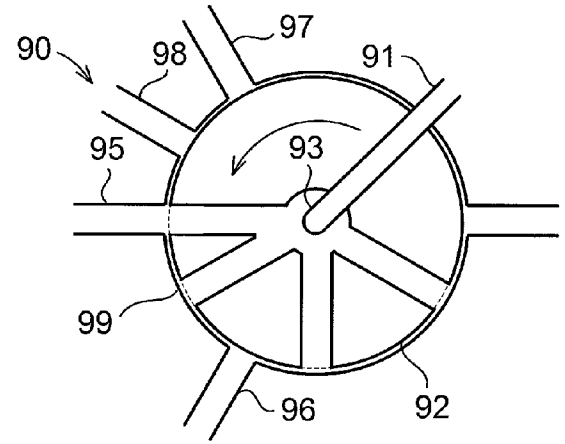
FIG. 6A is a bottom view depicting a port switching mechanism, in which a suction port is in communication with a black ink port in the illustrative embodiment according to one or more aspects of the disclosure.
Figure 6B:
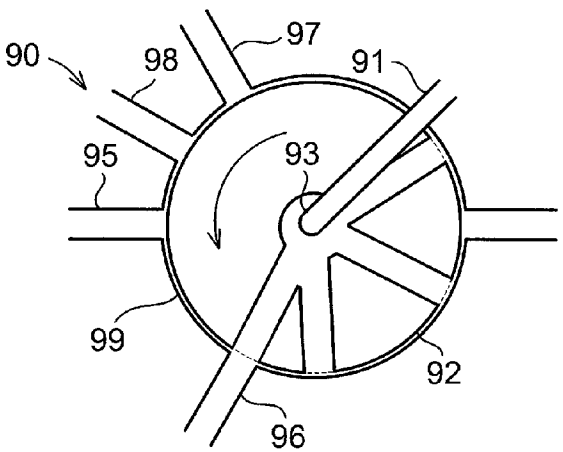
FIG. 6B is a bottom plan view depicting the port switching mechanism, in which the suction port is in communication with a color ink port in the illustrative embodiment according to one or more aspects of the disclosure.
Figure 6C:
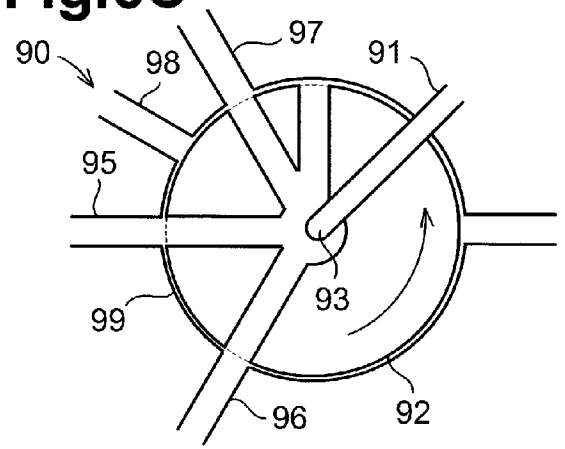
FIG. 6C is a bottom plan view depicting the port switching mechanism, in which the suction port is in communication with the black ink port, the color ink port, and an atmosphere port in the illustrative embodiment according to one or more aspects of the disclosure.
Figure 6D:
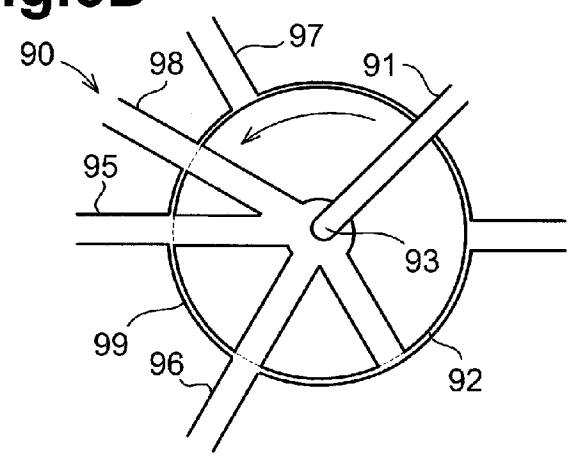
FIG. 6D is a bottom plan view depicting the port switching mechanism, wherein the suction port is in communication with the black ink port, the color ink port, and the atmosphere port in the illustrative embodiment according to one or more aspects of the disclosure.

When the conveyor motor 102 is driven to rotate reversely, the rotary body 92 rotates (e.g., counterclockwise in FIG. 6) in the cylinder 99. The communication states of the ports 95-98 in the cylinder are changed in accordance with the rotation of the rotary body 92 in the cylinder 99. In FIG. 6A, the suction port 93 is in communication with the black ink port 95. In FIG. 6B, the suction port 93 is in communication with the color ink port 96. In FIG. 6C, the suction port 93 is in communication with the black ink port 95, the color ink port 96, and the atmosphere port 97. In FIG. 6D, the suction port 93 is in communication with the black ink port 95, the color ink port 96, and the atmosphere port 98.

The cap 71 and the wiper blade 78 moves in response to the rotation of the rotary body 92. More specifically, the cap 71, which is moved by the lifting mechanism 73 to the position proximate to the nozzle surface, is in the capping position in the states depicted in FIGS. 6A-6C and is in the uncapping position in the state depicted in FIG. 6D. The wiper blade 78 is in the separated position at least in the sates depicted in FIG. 6(D). In short, the cap 71 and the wiper blade 78 are driven to move by the conveyor motor 102 rotating reversely.

When the rotary body 92 rotates to the state depicted in FIG. 6A, the black-ink cap portion of the cap 71 and the pump 76 come into communication with each other. When the pump 76 is driven, under this condition, by the conveyor motor 102 driven to rotate forward, the pressure in the internal space of the black-ink cap portion becomes lower than atmospheric pressure, whereby black ink and air existing in the nozzles 40 for black ink covered with the black-ink cap portion, or foreign objects adhering to the nozzle surface of the nozzles 40 for black ink are discharged into the black-ink cap portion (such ink, air, and foreign objects will be referred to as ink or the like, hereinafter). Subsequently, when the rotary body 92 rotates from the state depicted in FIG. 6A to the state depicted in FIG. 6B, the color-ink cap portion of the cap 71 comes into communication with the pump 76. When the pump 76 is driven under this condition, the pressure in the internal space of the color-ink cap portion becomes lower than atmospheric pressure, whereby ink and the like in the nozzles 40 for color ink covered with the color-ink cap portion are discharged into the color-ink cap portion.

When the rotary body 92 rotates from the state depicted in FIG. 6B to the state depicted in FIG. 6C, the suction port 93 comes into communication with the black ink port 95, the color ink port 96, and the atmosphere port 97 while the cap 71 is in close contact with the nozzle surface. When the pump 76 is driven under this condition, the ink and the like stored in the cap 71 are discharged to the waste ink tank 110 via the tubes 91A-91C, the port switching mechanism 90, and the pump 76. As the rotary body 92 further rotates from the state depicted in FIG. 6C to the state depicted in FIG. 6D, the suction port 93 comes into communication with the black ink port 95, the color ink port 96, and the atmosphere port 98 while the cap 71 is separated from the nozzle surface. When the pump 76 is driven under this condition, the ink or the like stored in the cap 71 is discharged to the waste ink tank 110 via the tubes 91A-91C, the port switching mechanism 90, and the pump 76.

[Waste Ink Tank 110]

Figure 7:
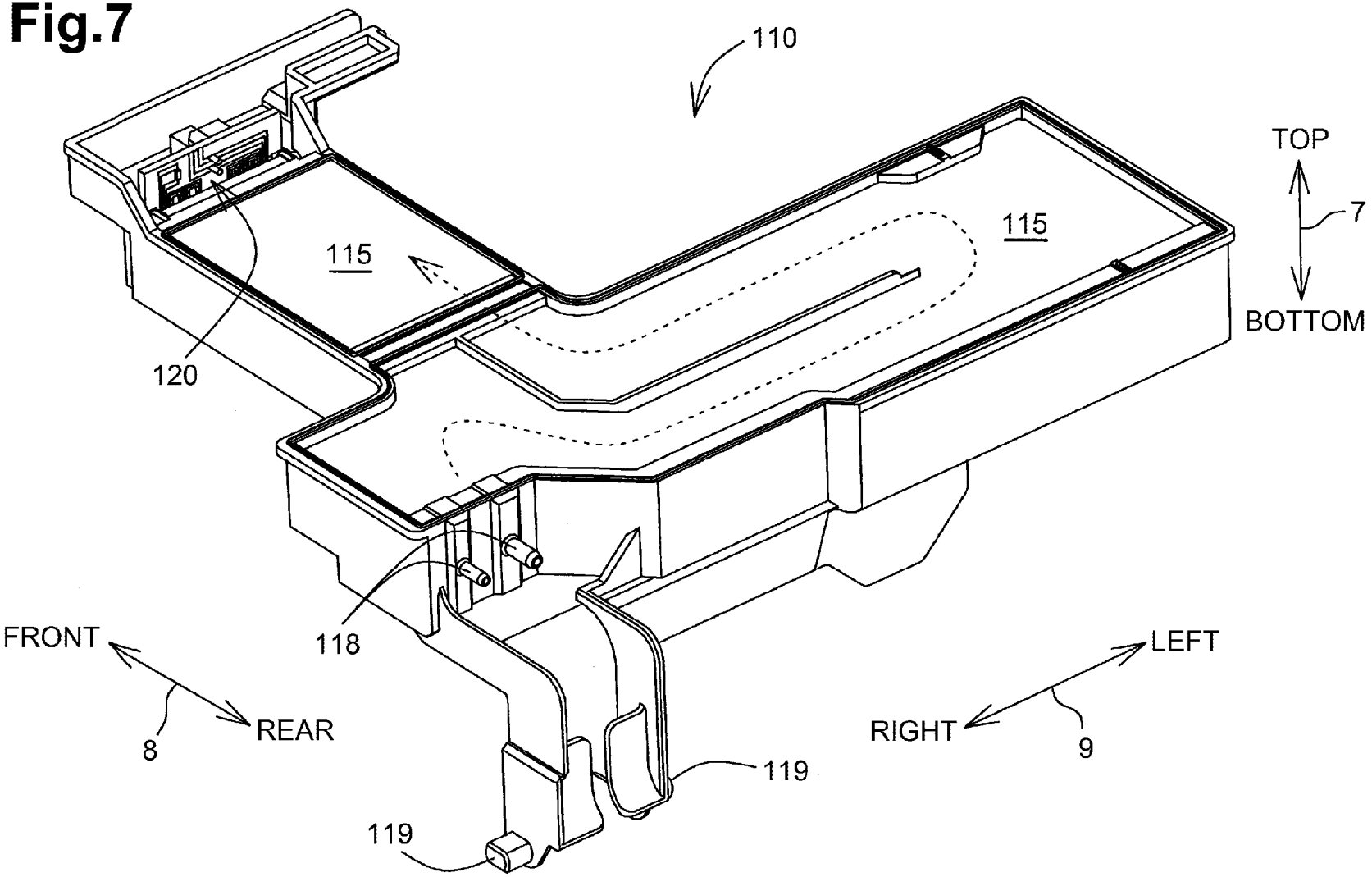
FIG. 7 is a perspective view depicting a waste ink tank in the illustrative embodiment according to one or more aspects of the disclosure.

As depicted in FIG. 7, the waste ink tank 110 has a substantially T-shaped box shape in plan view. The waste ink tank 110 includes an ink absorber 115 therein. The shape and placement of the waste ink tank 110 are not limited to the above example. In other embodiments, for example, the waste ink tank 110 may have any shape that is capable of holding the ink absorber 115 therein and the waste ink tank 110 may be disposed at any position inside of the multifunction device 10. In the illustrative embodiment, the waste ink tank 110 is detachably supported by the frame 68.

The tube 91C (see FIG. 5) is detachably connected to connectors 118 disposed on an outer face of a rear portion of the waste ink tank 110. Ink flowing into the waste ink tank 110 from the tube 91C via the connectors 118 is absorbed by the ink absorber 115, diffuses along a flow path indicated by a dashed line with an arrow in FIG. 7, and reaches a front portion of the waste ink tank 110. A pair of protrusions 119 project in the right-left direction 9 from a lower rear portion of the waste ink tank 110 so as to be inserted into holes formed in the frame 68 of the printer unit 11. The waste ink tank 110 is supported by the frame 68 via the protrusions fitted into the holes. A detection electrode 120 is disposed at a front end portion of the waste ink tank 110. The detection electrode 120 outputs a detection signal to a controller 130 depending on the amount of ink stored in the waste ink tank 110.

[Waste Ink Tray 50]

As depicted in FIG. 3A, the multifunction device 10 includes a waste ink tray 50 disposed in an area to the left of the recording area in the right-left direction 9. In the illustrative embodiment, the waste ink tray 50 is fixed to the frame 68. An ink absorber is accommodated in an internal space of the waste ink tray 50. The waste ink tray 50 has, at its upper face, an opening 51 which faces the lower face of the recording head 39 and through which the waste ink tray 50 receives ink droplets ejected from the recording head 30. The waste ink tray 50 is an example of an ink receiving member. The area to the left of the recording area is an example of a second outside area which is outside of the recording area in the main scanning direction and opposite to the first outside area relative to the recording area.

[Driving Force Transmission Mechanism 104]

Figure 8:
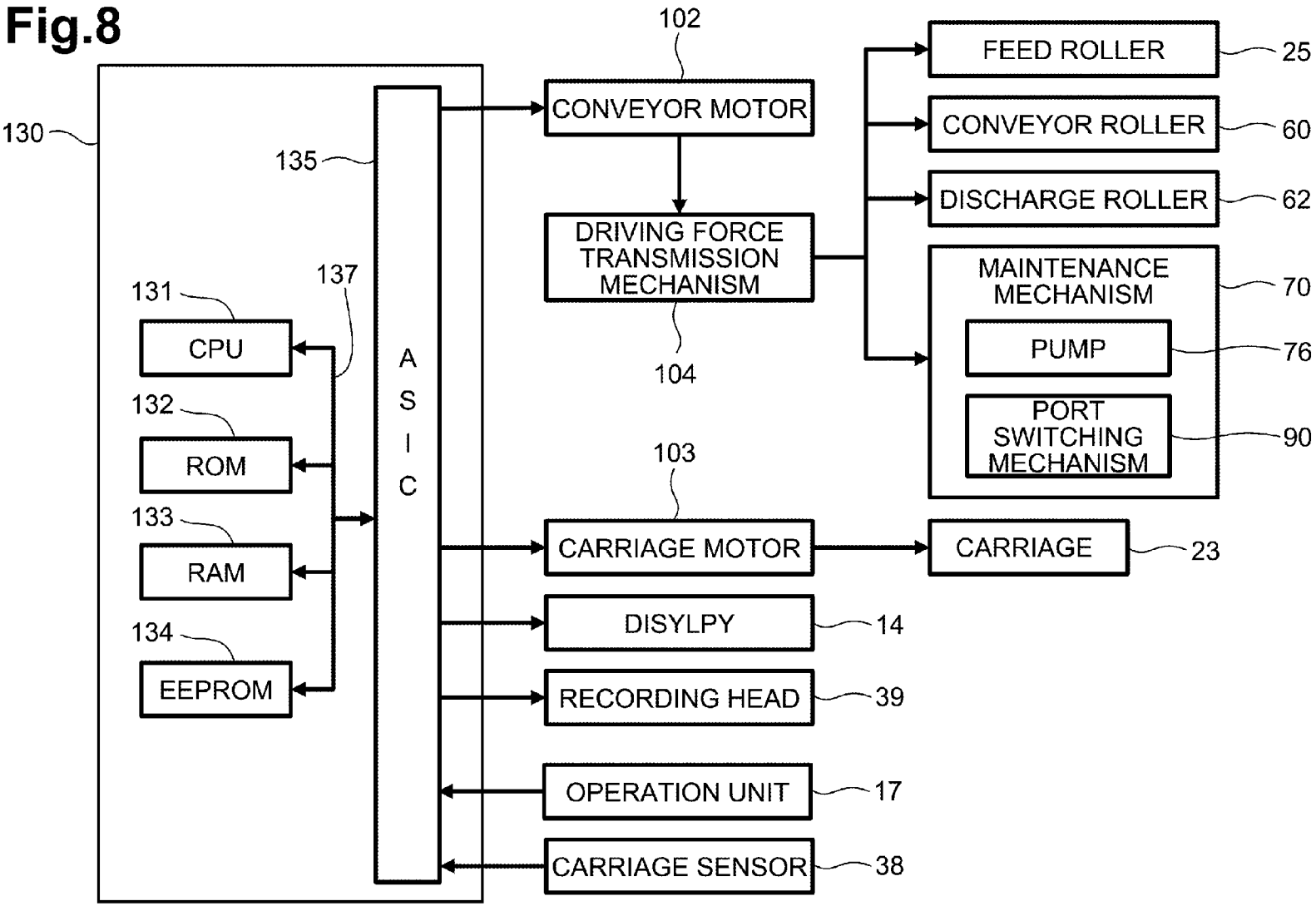
FIG. 8 is a block diagram depicting the printer unit in the illustrative embodiment according to one or more aspects of the disclosure.

A driving force transmission mechanism 104 depicted in FIG. 8 is configured to transmit a driving force of the conveyor motor 102 to the feed roller 25 and the maintenance mechanism 70. The driving force transmission mechanism 104 includes a combination of some or all of gears, pulleys, an annular belt, a planet gear mechanism (e.g., a pendulum gear mechanism), and a one-way clutch. Whether the driving force of the conveyor motor 102 is transmitted to the feed roller 25 or the maintenance mechanism 70 is changed by the carriage 23. The conveyor roller 60 and the discharge roller 62 rotate forward when the conveyor motor 102 is driven to rotate forward, irrespective of the position of the carriage 23.

More specifically, when the carriage 23 is located to the left of the position A in FIG. 3, the driving force transmission mechanism 104 transmits a driving force of the conveyor motor 102 to the feed roller 25, the conveyor roller 60, and the discharge roller 62 but not to the maintenance mechanism 70. In this state, a driving force of the conveyor motor 102 rotating forward is not transmitted to the feed roller 25, and the feed roller 25 rotates forward when the conveyor motor 102 is driven to rotate reversely.

When the carriage 23 is located to the right of the position A of FIG. 3 (i.e., when the contact lever 176 has been moved to the right), the driving force transmission mechanism 104 transmits a driving force of the conveyor motor 102 to the maintenance mechanism 70 but not to the feed roller 25. In this state, the driving force transmission mechanism 104 transmits a driving force of the conveyor motor 102 rotating forward to the pump 76, and transmits a driving force of the conveyor motor 102 rotating reversely to the port switching mechanism 90.

A one-way clutch disposed in a transmission path defined between the conveyor motor 102 and the components allows selective transmission of a driving force of the conveyor motor 102 to the feed roller 25, the pump 76, and to the port switching mechanism 90. A pendulum gear mechanism or a solenoid clutch mechanism may be used instead of the one-way clutch. The driving force transmission mechanism 104 is an example of a switching mechanism.

[Controller 130]

As depicted in FIG. 8, the controller 130 includes a central processing unit ("CPU") 131, a read-only memory ("ROM") 132, a random-access memory ("RAM") 133, an electrically erasable programmable read only memory ("EEPROM") 134, and an application-specific integrated circuit ("ASIC") 135 that are connected with each other via an internal bus 137. The ROM 132 stores programs for the CPU 131 to control various operations. The RAM 133 is employed as a storage area for temporarily storing data or signals to be used for the CPU 131 to execute the programs, or as a workspace for data processing by the CPU 131. The EEPROM 134 is configured to store settings and flags that need to be held after the multifunction device 10 is powered off.

The ASIC 135 is connected with the conveyor motor 102 and the carriage motor 103. The ASIC 135 receives a drive signal for rotating a predetermined motor from the CPU 131 to output a drive current responsive to the drive signal to the predetermined motor. The predetermined motor thus rotates by the application of the drive current from the ASIC 135. For example, the controller 130 drives the rollers or the maintenance mechanism 70 by controlling driving of the conveyor motor 102. The controller 130 controls the recording head 39 to eject ink from appropriate one or more of the nozzles 40. A carriage sensor 38 is connected to the ASIC 135. The controller 130 detects the position of the carriage 23 based on pulse signals outputted from the carriage sensor 38.

The controller 130 reciprocates the carriage 23 by controlling driving of the carriage motor 103. More specifically, the controller 130 moves the carriage 23 at a first speed in the recording area, and at a second speed in an outside area which is to the right of the recording area. In the outside area, the carriage 23 is contactable with the maintenance mechanism 70, or more specifically, the carriage 23 contacts the contact lever 176 and moves the lifting mechanism 73. The second speed is lower than the second speed. This may prevent breakage of ink meniscuses in the nozzles 39 while preventing a reduction of the throughput of recording processing, as will be described later.

[Image Recording Processing]

Image recording processing will be described referring to FIG. 9. This processing is executed by the CPU 131 of the controller 130. Processing steps described below may be executed by the CPU 131 that reads a program stored in the ROM 132 or may be executed by a hardware circuit installed on the controller 130. The image recording processing will be described with reference to rotations of the feed roller 25, the conveyor roller 60, and the discharge roller 62, movement of the carriage 23, and driving of the maintenance mechanism 70. Operations of the rollers 25, 60, and 62, the carriage 23, and the maintenance mechanism 70 are realized by driving the conveyor motor 102 and the carriage motor 103, as described above.

Figure 9:
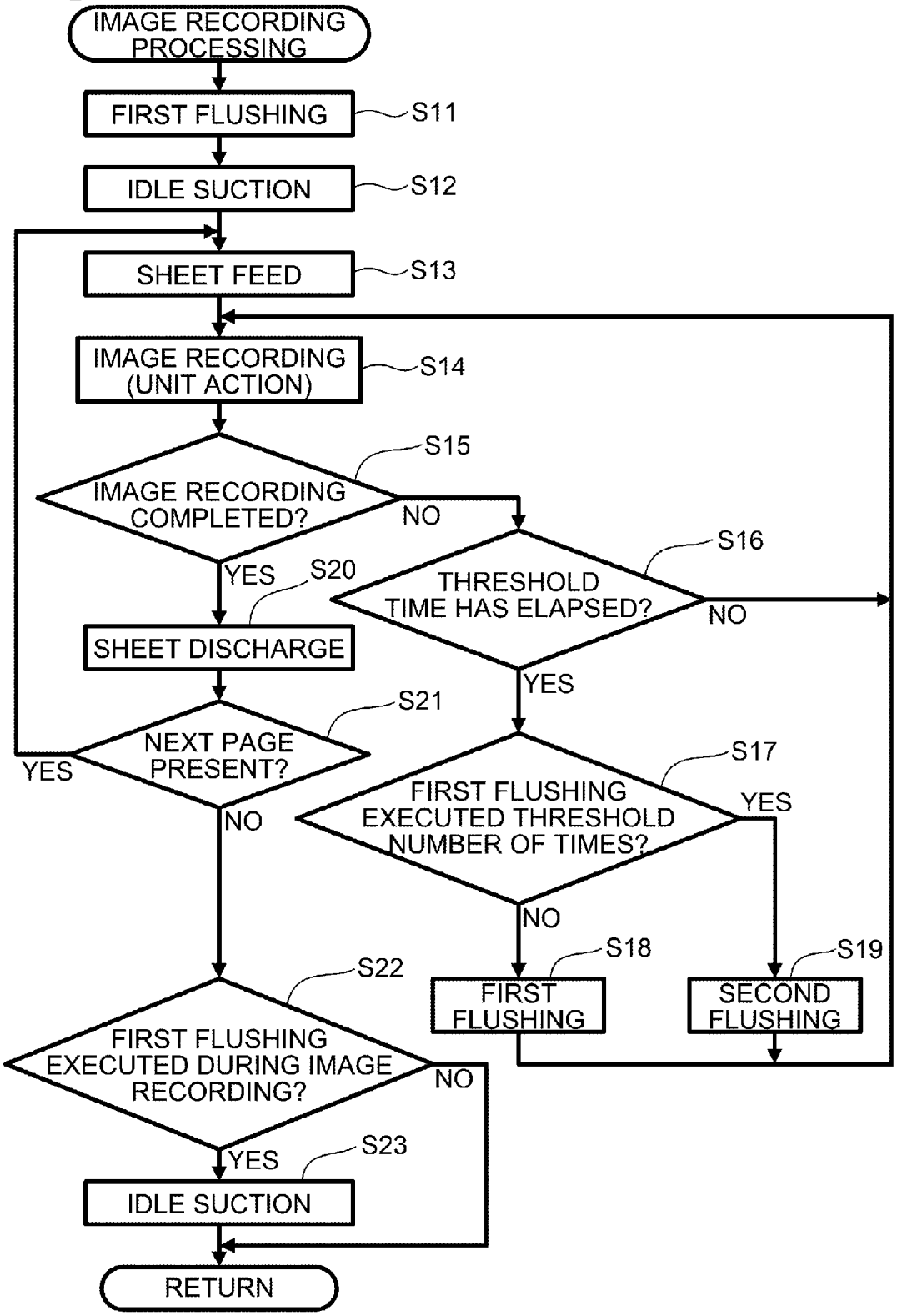
FIG. 9 is a flowchart depicting image recording processing in the illustrative embodiment according to one or more aspects of the disclosure.

The controller 130 executes the image recording processing depicted in FIG. 9 on condition that the controller 130 receives a recording instruction from a user. The controller 130 may receive a recording instruction inputted through the operation unit 17 of the multifunction device 10 or through an external device connected to the multifunction device 10 via a communication network. The controller 130 control the rollers 25, 60, and 62, the carriage 23, and the recording head 39 and executes image recording on the sheet 12. In the illustrative embodiment, when the multifunction device 10 is on standby for receiving a recording instruction, the carriage 23 is kept at the position B and the port switching mechanism 90 is kept in the state depicted in FIG. 6C. Accordingly, the cap 71 is kept in the capping position, thereby preventing ink in the nozzles 40 from drying.

First, the controller 130 executes first flushing by controlling the recording head 39 to idly eject ink toward the cap 71 (e.g., step S11). More specifically, the controller 130 rotates the rotary body 92 such that the port switching mechanism 90 is brought into the state depicted in FIG. 6D while the carriage 23 remains at the position B. Subsequently, the controller 130 controls the recording head 39 to idly eject ink while the carriage 23 is kept at the position B. The ink is discharged from the recording head 39 into the cap 71. Subsequently, the controller 130 executes idle suction in which the ink in the cap 71 is discharged to the waste ink tank 110 (e.g., step S12). More specifically, the controller 130 drives the pump 76 while the carriage 23 and the port switching mechanism 90 are in the same position/state as those at the time of the first flushing (step S11).

Subsequently, the controller 130 rotates the feed roller 25 forward to feed the sheet 12 to the conveyor roller pair 54 (e.g., step S13). When the sheet 12 reaches the conveyor roller pair 54, the controller 130 controls the conveyor roller 60 and the discharge roller 62 (hereinafter referred to as a "conveying unit") to convey the sheet 12 by a predetermined line feed length in the conveying direction 16, and controls the recording unit 24 to record an image on the sheet 12 (e.g., step S14). In short, the controller 130 executes the recording processing after a recording instruction is received and the first flushing (step S11) and the idle suction (step S12) are executed. Step S14 is an example of a unit action and is repeated until image recording on the sheet 12 is completed (e.g., Yes in step S15).

On condition that one of repetitive unit actions (step S14) is completed (e.g., No in step S15) and a threshold time has elapsed (e.g., Yes in step S16), the controller 130 executes the first flushing (e.g., step S18) or second flushing (e.g., step S19). Step S16 is an example of a step for detecting arrival of one or more flushing timings. Each flushing timing arrives both when a time elapsing from execution of the latest flushing (S11 or S18 or S19) exceeds the threshold time and when one of repetitive unit actions (S14) is completed.

When the controller 130 detects one or more flushing timings in a single image recording processing, the controller 130 executes the first flushing (e.g., step S18) for the first to Nth flushing timings (e.g., Yes in step S17) and executes the second flushing (e.g., step S19) for the (N+1)th and later flushing timings (e.g., step S19). The first flushing in step S11 and the first flushing in step S18 are executed in the same manner. In contrast, in the second flushing (e.g., step S19), the controller 130 controls the recording head 39 to idly eject ink toward the opening 51 of the waste ink tray 50. More specifically, the controller 130 moves the carriage 23 to a position opposing the opening 51 and controls the recording head 39 to idly eject ink. The ink is discharged from the recording head 39 to the waste ink tray 50. N is an example of a threshold number of times and is an integer greater than 0 (zero).

Subsequently, on condition that image recording on the sheet 12 is completed (e.g., Yes in step S15), the controller 130 executes discharging of the sheet 12 to the discharge tray 21 (e.g., step S20). More specifically, the controller 130 rotates the conveying unit forward until a trailing edge of the sheet 12 (an upstream edge of the sheet 12 in the conveying direction 16) passes the discharge roller pair 55. The controller 130 execute steps S13-S21 repeatedly until the image recording on one or more pages is completed (e.g., No in step S21) as instructed by the recording instruction.

Subsequently, on condition that the first flushing has been executed in step S18 (e.g., Yes in step S22), the controller 130 executes idle suction (e.g., step S23) following the completion of all the image recording (e.g., No in step S21) and ends the image recording processing. Contrarily, on condition that the first flushing has not been executed in step S18 (e.g., No in step S22), the controller 130 skips step S23. The idle suction in step S12 and the idle suction in step S23 are executed in the same manner.

[Maintenance Processing]

Figure 10:
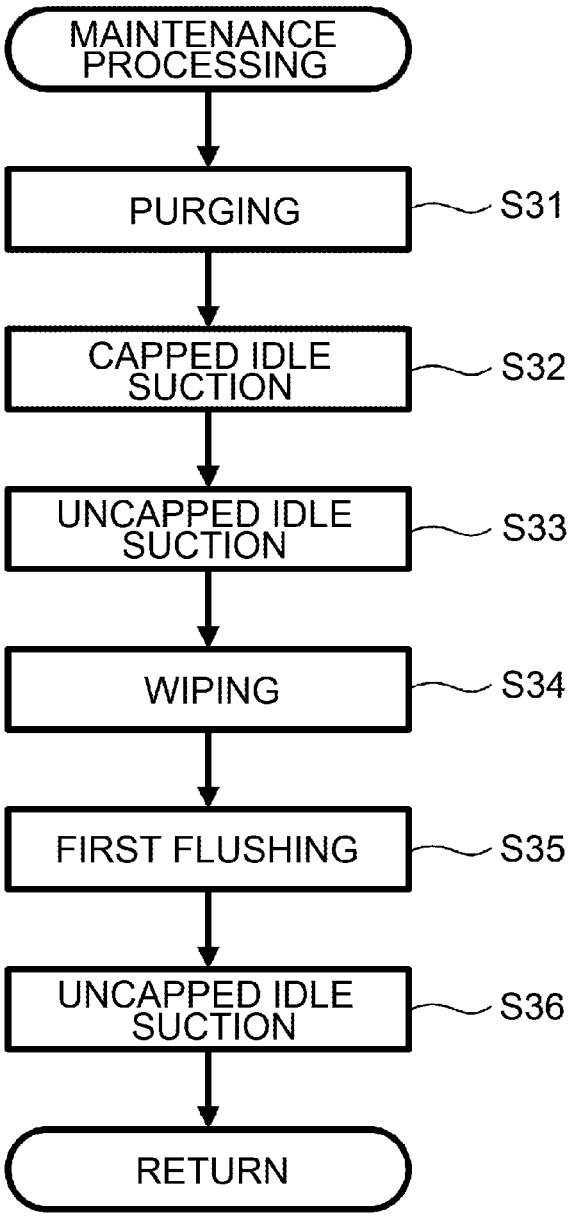
FIG. 10 is a flowchart depicting maintenance processing in the illustrative embodiment according to one or more aspects of the disclosure.

Maintenance processing will now be described referring to FIG. 10. This processing is executed by the CPU 131 of the controller 130. Processing steps described below may be executed by the CPU 131 that reads a program stored in the ROM 132 or may be executed by a hardware circuit installed on the controller 130.

The maintenance processing is executed to maintain the nozzles 40 of the recording head 39 when a predetermined time has elapsed since execution of the latest maintenance or when the controller 130 receives a maintenance instruction inputted by a user through the operation unit 17. The maintenance processing will be described with reference to movement of the carriage 23 and driving of the maintenance mechanism 70. Operations of the carriage 23 and the maintenance mechanism 70 are realized by driving the conveyor motor 102 and the carriage motor 103, as described above.

First, the controller 130 executes purging by driving the pump 76 to discharge ink from the nozzles 40 (e.g., step S31). More specifically, the controller 130 moves the carriage 23 to the position B, rotates the rotary body 92 such that the port switching mechanism 90 is brought into the state depicted in FIG. 6A, and drives the pump 76. Black ink, color ink and the like in the nozzles 40 are sucked and removed by the pump 76 via the cap 71.

Subsequently, the controller 130 executes capped idle suction (e.g., step S32) and uncapped idle suction (e.g., step S33). More specifically, in the capped idle suction (e.g., step S32), the controller 130 rotates the rotary body 92 such that the port switching mechanism 90 changes from the state depicted in FIG. 6B into the state depicted in FIG. 6C, and drives the pump 76. In the uncapped idle suction (e.g., step S33), the controller 130 rotates the rotary body 92 such that the port switching mechanism 90 changes from the state depicted in FIG. 6C into the state depicted in FIG. 6D, and drives the pump 76. The driving speed of the pump 76 in the capped idle suction may be lower than that in the uncapped idle suction.

Subsequently, the controller 130 executes wiping in which the wiper blade 78 wipes the nozzle surface (e.g., step S34). More specifically, the controller 130 moves the carriage 23 leftward while maintaining the port switching mechanism 90 in the state depicted in FIG. 6D such that the wiper blade 78 makes slide contact the nozzle surface. After the carriage 23 passes the wiper blade 78, the controller 130 moves the carriage 23 reversely to the position B. Subsequently, the controller 130 executes first flushing (e.g., step S35) and uncapped idle suction (e.g., step S36), and ends the maintenance processing. The first flushing (e.g., step S35) is executed in the same manner as in steps S11 and S18. The uncapped idle suction (e.g., step S36) is executed in the same manner as in step S12 and S23 in FIG. 9

[Effects of Illustrative Embodiment]

According to the illustrative embodiment, in the multifunction device 1 which includes the irreplaceable waste ink tray 50 and the replaceable waste ink tank 110, the first flushing (e.g., step S11), in which a relatively large amount of ink is discharged from the nozzles 40 via the cap 71 to the replaceable waste ink tank 110, is executed prior to image recording, and the second flushing (e.g., step S19), in which a relatively small amount of ink is discharged at a time from the nozzles 40 to the irreplaceable waste ink tray 50, is executed during image recording. Consequently, the ink absorber in the waste ink tray 50 may be used frugally, thereby preventing a reduction of service life of the multifunction device 10. In the illustrative embodiment, the carriage 23, when approaching the maintenance mechanism 70, is required to move at a relatively low speed so as not to break ink meniscuses in the nozzles. Thus, execution of the second flushing during image recording may prevent a reduction of throughput of image recording.

The irreplaceable waste ink tray 50 means that the waste ink tray 50 is not designed to be replaced in the multifunction device 10 by a user and that a replacement waste ink tray 50 is not available. The replaceable waste ink tank 110 means that the waste ink tank 110 in the multifunction device 10 is designed to be replaced by a user and a replacement waste ink tank 110 is available. Replacement of the waste ink tank 110 refers to replacement of not only the waste ink tank 110 but also the ink absorber 115.

The first flushing (e.g., step S18) may be executed a predetermined number of times (N times in the illustrative embodiment depicted in FIG. 9) during image recording. For example, the first flushing may be executed during image recording as many times as the discharged ink does not overflow the cap 71. Thus, a threshold number of times may be set in consideration of the amount of ink discharged per single first flushing and the capacity of the cap 71. The image processing depicted in FIG. 9 may be effective especially when prevention of a reduction of service life of the multifunction device 10 is prioritized over improvement of throughput of image recording.

High throughput is not required when an image having high resolution is recoded on the sheet 12. The moving speed of the carriage 23 is usually lowered in the case of recording a high-resolution image than in the case of recording a low-resolution image, in order to increase the number of ink droplets landing on the sheet 12 per unit area and to enhance the accuracy of landing positions of ink droplets on the sheet 12. In the case of recording a high-resolution image, high throughput of image recording may not be severely required and thus flushing timings may relatively increase. Execution of the first flushing for the first to Nth flushing timings may prevent a reduction of service life of the multifunction device 10. The same may apply to the case where the carriage 23 moves at a relatively low speed for other reasons than to perform high-resolution image recording.

Specifically, the first flushing (e.g., step S18) may be executed for the first to Nth flushing timings when the resolution of an image being recorded exceeds a threshold resolution, and the second flushing (e.g., step S19) may be executed for all the flushing timings when the resolution of an image being recoded does not exceed the threshold resolution. Alternatively, the first flushing (e.g., step S18) may be executed for the first to Nth flushing timings when the moving speed of the carriage 23 in image recording is less than a threshold speed, and the second flushing (e.g., step S19) may be executed for all the flushing timings when the moving speed of the carriage 23 in image recording is greater than or equal to the threshold speed.

Specifically, in step S17 of the image recording processing, the controller may be configured to determine whether an image being recorded has a resolution higher than a threshold resolution, in addition to determining whether the first flushing has been executed a threshold number of times (N times). If both conditions that the former determination is affirmative and the latter determination is negative are satisfied, the controller may execute the first flushing (e.g., step S18) for the first to Nth flushing timings. If at least one of the conditions is not satisfied, the controller may execute the second flushing (e.g., step S19) for each of the flushing timings.

Alternatively, in step 17 of the image recording processing, the controller may be configured to determine whether a moving speed of the carriage 23 in the recording area is greater than or equal to a threshold speed, in addition to determining whether the first flushing has been executed a threshold number of times (N times). If both conditions that the former determination is negative and the latter determination is negative, the controller may execute the first flushing (e.g., step S18) for the first to Nth flushing timings. If at least one of the conditions is not satisfied, the controller may execute the second flushing (e.g., step S19) for each of the flushing timings.

The threshold number of times (N times) may be changed depending on which is prioritized between improvement of throughput of image recording and prevention of a reduction of service life of the multifunction device 10.

Driving the pump 76 somewhere in steps S13-S20 causes the conveyor roller pair 54 and the discharge roller pair 55 to rotate and convey the sheet 12 on which an image is being recorded. Therefore, execution of idle suction is not allowed in steps S13-20. Executing the idle suction (e.g., steps S12 and S23) before step S13 or after step S20 allows the pump to discharge the ink in the cap to the waste ink tank 10 without affecting image recording. The processes of steps S22 and S23 may be executed between step S20 and step S21. In this case, throughput of image recording may decrease but the threshold number of times N may increase as compared to the case depicted in FIG. 9. This case may be effective especially when prevention of service life of the multifunction device 10 is prioritized over improvement of throughput of image recording.

In the illustrative embodiment, the first flushing (e.g., step S35) is executed following the purging (e.g., step S31). This may reduce the number of executions of second flushing and the amount of ink discharged by the executions of second slushing. Consequently, a reduction of service life of the multifunction device 10 may be prevented. In the maintenance processing, the first flushing (e.g., step S35) and the uncapped idle suction (e.g., step S36) may be executed in parallel, thereby improving throughput of the maintenance processing. The first flushing (e.g., step S11) and the idle suction (e.g., step S12) in FIG. 9 may also be executed in parallel.

Although, in the above-described illustrative embodiment, the conveyor roller 60 and the maintenance mechanism 70 are driven by the common conveyor motor 102, the conveyor 60 and the maintenance mechanism 70 may be driven by separate motors.

Although, in the above-described illustrative embodiment, the sheets 12 are described as recording media, cardboard, corrugated cardboard, and optical disks, such as CD-ROMs (Compact Disc-Read Only Memories) and DVD-ROMs (Digital Versatile Disk-Read Only Memories) may be used other than the sheets 12.

While the disclosure has been described in detail with reference to the specific embodiments thereof, various changes, arrangements and modifications may be applied therein without departing from the spirit and scope of the disclosure.

What is claimed is:

1. An inkjet recording apparatus comprising:

a conveying unit configured to convey a recording medium in a conveying direction;

a carriage configured to move in a main scanning direction perpendicular to the conveying direction;

a recording head mounted on the carriage and configured to face the recording medium conveyed in a recording area by the conveying unit and to eject ink;

a maintenance mechanism comprising:

a cap disposed in a first outside area which is outside of the recording area in the main scanning direction;

a waste ink storage detachably attached to the inkjet recording apparatus; and a pump configured to discharge ink in the cap to the waste ink storage;

an ink receiving member fixedly attached, in a second outside area, to the inkjet recording apparatus, the second outside area being outside of the recording area in the main scanning direction and opposite to the first outside area relative to the recording area; and a controller configured to:

receive a recording instruction for recording an image on the recording medium;

execute, after receiving the recording instruction, first flushing by controlling the recording head to idly eject ink toward the cap;

execute, after executing the first flushing, image recording by controlling the conveying unit and the recording head to repeat a unit action in which the recording head ejects ink onto the recording medium conveyed by a predetermined line feed length in the conveying direction;

detect arrival of one or more flushing timings, wherein each of the one or more flushing timings arrives during the image recording both when a threshold time elapses and when one of repeated unit actions is completed;

when a moving speed of the carriage in the recording area is less than a threshold speed:

execute the first flushing at each of first to Nth flushing timings of the one or more flushing timings, wherein N is greater than 0; and execute, after detecting the arrival of each timing after the Nth flushing timing, of the one or more flushing timings, second flushing by controlling the recording head to idly eject ink toward the ink receiving member; and when the moving speed of the carriage in the recording area is greater than or equal to the threshold speed, execute, after detecting the arrival of each of the one or more flushing timings, the second flushing.

2. The inkjet recording apparatus according to claim 1, further comprising:

a motor configured to drive the conveying unit; and a switching mechanism configured to transmit a driving force of the motor to the pump when the carriage is in the first outside area and to not transmit the driving force of the motor to the pump when the carriage is in the recording area, wherein the controller is configured to execute, after the first flushing executed before the image recording, idle suction by driving the pump to discharge the ink in the cap to the waste ink storage.

3. The inkjet recording apparatus according to claim 2, wherein the carriage is configured to contact the maintenance mechanism in the first outside area, and wherein the controller is configured to move the carriage in the recording area at a first speed, and to move the carriage in the first outside area at a second speed which is lower than the first speed.

4. The inkjet recording apparatus according to claim 2, wherein the controller is configured to further execute the idle suction after completion of the image recording instructed by the recording instruction if the first flushing is executed during the image recording.

5. The inkjet recording apparatus according to claim 1, wherein the recording head comprises a nozzle surface in which nozzles are formed, wherein the cap is movable between a capping position in which the cap covers the nozzle surface, and an uncapping position in which the cap is separated from the nozzle surface, and wherein the controller is configured to:

execute purging by driving the pump while the cap is in the capping position, and after executing the purging, move the cap to the uncapping position and further execute the first flushing.

6. The inkjet recording apparatus according to claim 5, wherein the controller is configured to further execute, in parallel with the first flushing, idle suction by driving the pump while the cap is in the uncapping position.

7. The inkjet recording apparatus according to claim 1, wherein the controller is configured to monitor the threshold time elapsing from completion of a latest one of the first flushing and the second flushing.

8. The inkjet recording apparatus according to claim 1, further comprising:

a motor configured to drive the conveying unit; and a switching mechanism configured to transmit a driving force of the motor to the pump when the carriage is in the first outside area and to not transmit the driving force of the motor to the pump when the carriage is in the recording area, wherein the controller is configured to execute, in parallel with the first flushing executed before the image recording, idle suction by driving the pump to discharge the ink in the cap to the waste ink storage.

9. An inkjet recording apparatus comprising:

a conveying unit configured to convey a recording medium in a conveying direction;

a carriage configured to move in a main scanning direction perpendicular to the conveying direction;

a recording head mounted on the carriage and configured to face the recording medium conveyed in a recording area by the conveying unit and to eject ink;

a maintenance mechanism comprising:

a cap disposed in a first outside area which is outside of the recording area in the main scanning direction;

a waste ink storage detachably attached to the inkjet recording apparatus; and a pump configured to discharge ink in the cap to the waste ink storage;

an ink receiving member fixedly attached, in a second outside area, to the inkjet recording apparatus, the second outside area being outside of the recording area in the main scanning direction and opposite to the first outside area relative to the recording area; and a controller configured to:

receive a recording instruction for recording an image on the recording medium;

execute, after receiving the recording instruction, first flushing by controlling the recording head to idly eject ink toward the cap;

execute, after executing the first flushing, image recording by controlling the conveying unit and the recording head to repeat a unit action in which the recording head ejects ink onto the recording medium conveyed by a predetermined line feed length in the conveying direction;

detect arrival of one or more flushing timings, wherein each of the one or more flushing timings arrives during the image recording both when a threshold time elapses and when one of repeated unit actions is completed;

when the image to be recorded has a resolution higher than a threshold resolution:

execute the first flushing after detecting the arrival of each of first to Nth flushing timings of the one or more flushing timings, wherein N is greater than 0; and execute, after detecting the arrival of each timing after the Nth flushing timing, of the one or more flushing timings, second flushing by controlling the recording head to idly eject ink toward the ink receiving member; and when the image being recorded has a resolution lower than or equal to the threshold resolution, execute, after detecting the arrival of each of the one or more flushing timings, the second flushing.

10. The inkjet recording apparatus according to claim 9, wherein the controller is configured to execute, before the image recording, idle suction by driving the pump to discharge to the ink storage the ink ejected in the cap during the first flushing executed before the image recording.

* * * * *